US012044252B2

(12) United States Patent
Jaeger et al.

(10) Patent No.: US 12,044,252 B2
(45) Date of Patent: Jul. 23, 2024

(54) WIPING ELEMENT FOR IMPELLER LEADING EDGES OF WASTEWATER PUMPS

(71) Applicant: KSB SE & Co. KGaA, Frankenthal (DE)

(72) Inventors: Christoph Jaeger, Frankenthal (DE); Mateusz Kaminski, Loos (FR); Enrico Mueller, Frankenthal (DE); Nicolas Petit, Hazebrouc (FR)

(73) Assignee: KSB SE & Co. KGaA, Frankenthal (DE)

( * ) Notice: Subject to any disclaimer, the term of this patent is extended or adjusted under 35 U.S.C. 154(b) by 2 days.

(21) Appl. No.: 17/635,236

(22) PCT Filed: Aug. 3, 2020

(86) PCT No.: PCT/EP2020/071792

§ 371 (c)(1),
(2) Date: Feb. 14, 2022

(87) PCT Pub. No.: WO2021/028246

PCT Pub. Date: Feb. 18, 2021

(65) Prior Publication Data

US 2022/0290695 A1 Sep. 15, 2022

(30) Foreign Application Priority Data

Aug. 15, 2019 (EP) ..... 19191970

(51) Int. Cl.
*F04D 29/22* (2006.01)
*F04D 7/04* (2006.01)
*F04D 29/70* (2006.01)

(52) U.S. Cl.
CPC ..... *F04D 29/708* (2013.01); *F04D 7/04* (2013.01); *F04D 29/2288* (2013.01)

(58) Field of Classification Search
CPC ..... F04D 29/708; F04D 7/04; F04D 29/2288; F04D 29/24; F04D 29/329; F04D 29/28
(Continued)

(56) References Cited

U.S. PATENT DOCUMENTS 3,340,812 A * 9/1967 Schlesiger ..... F04D 7/045 415/121.1
4,604,035 A 8/1986 Roberts
(Continued)

OTHER PUBLICATIONS

International Preliminary Report on Patentability (PCT/IB/338 & PCT/IB/373) issued in PCT Application No. PCT/EP2020/071792 dated Feb. 24, 2022, Including English translation of document C2 (German-language Written Opinion (PCT/ISA/237), filed on Feb. 14, 2022) (seven (7) pages).
(Continued)

*Primary Examiner* — Hung Q Nguyen
*Assistant Examiner* — Anthony Donald Taylor, Jr.
(74) *Attorney, Agent, or Firm* — Crowell & Moring LLP

(57) ABSTRACT

A wastewater pump for conveying solids-laden wastewater includes a spiral housing with an inlet opening, an impeller with at least one vane having a leading edge running from the impeller hub in a backwardly curved manner, and at least one finger for wiping off contaminants from the leading edge. The at least one finger is arranged on the inlet inner wall and extends in the direction of the impeller rotational axis. At least one groove is present in a suction-side inner wall of the housing to receive and convey material that is removed by the at least one finger from the leading edge to. The leading edge of the impeller and the surface of the at least one finger which faces toward the leading edge are at an angle of 5° to 75° with respect to the rotational axis.

18 Claims, 9 Drawing Sheets

(58) Field of Classification Search
USPC ..... 415/121.1
See application file for complete search history.

(56) References Cited

U.S. PATENT DOCUMENTS

| | | | | |
|---|---|---|---|---|
| 6,190,121 | B1 * | 2/2001 | Hayward | F04D 7/045 415/206 |
| 9,828,999 | B2 * | 11/2017 | Andersson | F04D 29/042 |
| 10,837,456 | B2 * | 11/2020 | Kawai | F04D 29/70 |
| 2003/0215331 | A1 * | 11/2003 | Andersson | F04D 7/045 415/206 |
| 2009/0022582 | A1 * | 1/2009 | Andersson | F04D 15/0033 415/170.1 |
| 2009/0123270 | A1 * | 5/2009 | Andersson | F04D 7/045 415/140 |
| 2009/0169365 | A1 * | 7/2009 | Andersson | F04D 7/045 415/121.1 |

OTHER PUBLICATIONS

International Search Report (PCT/ISA/210) issued in PCT Application No. PCT/EP2020/071792 dated Oct. 7, 2020 with English translation (five (5) pages).
German-language Written Opinion (PCT/ISA/237) issued in PCT Application No. PCT/EP2020/071792 dated Oct. 7, 2020 (five (5) pages).
German-language European Search Report issued in European Application No. 19191970.3 dated Jan. 17, 2019 with partial English translation (three (3) pages).

* cited by examiner

WIPING ELEMENT FOR IMPELLER LEADING EDGES OF WASTEWATER PUMPS

BACKGROUND AND SUMMARY OF THE INVENTION

The invention relates to a wastewater pump having a helical housing having an inlet opening and an impeller having at least one vane, wherein the leading edge which is associated with the respective vane extends outward in a manner curved backward from the impeller hub.

Wastewater may contain various types of solids, such as fiber materials, the quantity and structure of which may be dependent on the wastewater source and the season. In towns, for example, plastics materials, hygiene articles, textiles, etcetera, are conventional, whilst in industrial areas wear particles may be contained. Experience has shown that the most significant problems occur in wastewater pumps as a result of fiber materials, such as rags, cloths and the like, which can become jammed at the leading edges of the vanes and which can become wound around the impeller hub. Such incidents lead to frequent service intervals and a reduced degree of efficiency of the pump.

There are already various approaches to a solution which use cutting tools or wiping tools in order to be able to remove the harmful substances which have settled on the leading edges during pump operation.

An object of the present invention is to improve existing solutions.

This object is achieved with a wastewater pump according to the features of the claims.

The starting basis for the invention is a wastewater pump for conveying solid-laden wastewater. The wastewater pump comprises an impeller having at least one impeller vane which is curved backward. The impeller is connected in a rotationally secure manner to a rotating shaft and is located in a helical pump housing having an inlet opening. The inlet opening may be orientated axially and/or may be cylindrical. The leading edge of the at least one impeller vane extends from the impeller hub with the backwardly curved vane form mentioned in a radially outward direction. On the inner wall of the inlet opening, a finger is securely connected to the pump housing. The region of the transition of the finger to the inner wall of the inlet opening is adjoined by a groove which is formed in the intake-side side wall of the pump housing and extends outward in a radial and tangential direction in the pump housing wall.

The finger extends from the inlet inner wall radially inward in the direction of the rotation axis of the impeller. An upper finger surface which faces the leading edge extends with defined spacing with respect to the leading edge and substantially parallel with the leading edge so that, as a result of the upper finger surface which faces the leading edge or the lateral attack face of the finger, the desired wiping action is produced. The cooperation of the leading edge which is curved backward and finger promotes the removal of solid materials which have settled on the impeller leading edge. Using the finger, the solids which have been deposited are supplied to the groove and also conveyed by the rotational movement of the impeller so that they reach the region of the housing pressure nozzle directly via the groove. The impeller and the finger are specifically adapted to each other for this objective.

According to the invention, there may be provision for the impeller leading edge to be positioned with respect to the perpendicular projection face of the rotation axis of the impeller at an angle $\alpha$ of from 5° to 75°. Consequently, in order to wipe the solids, in addition to the rotational movement and resulting radial force, an axial component acts on the solids. The removal of the solids which have been wiped away through the groove is thereby optimized. Preferably, the angle $\alpha$ may be in a value range between 10° and 45°.

To almost the same extent, the upper finger surface of the finger may also be inclined with respect to the perpendicular projection face through the angle $\alpha$. However, the upper finger surface and the leading edge do not necessarily have to extend precisely in a parallel manner so that in this instance different angles $\alpha$ with respect to the projection face are also conceivable. In particular, there may be provision for the upper finger surface not to be configured in a planar manner, but instead to be curved so that in this instance a varying angle $\alpha$ for the finger surface and consequently also a varying spacing between the leading edge and upper finger surface can be produced. Preferably, the upper finger surface may provide a curvature both in a radial direction and in a tangential direction. Ideally, the upper finger surface has a conical curvature in a radial and tangential direction.

The wastewater pump can be operated both in a dry state and in a state submerged in the conveying medium in any orientation. The helical housing of the pump has a spur and a pressure nozzle. Furthermore, the pump housing may have in the region of the inlet opening a separate housing insert, such as, for example, a suction cover or a closure wall, in which the above-mentioned groove can be introduced or on which the finger can be fitted.

During the pump operation, the leading edge of the at least one vane moves past the upper finger surface at an angle $\beta$ with respect to the lateral attack face of the finger. Ideally, this angle $\beta$ should be approximately 90° in order to achieve an optimum wiping action. In order to reduce the risks of solids becoming jammed between the impeller leading edge and finger, the angle $\beta$ should increase outward in a radial direction. This means that, as the radius becomes larger (starting from the impeller hub), the angle $\beta$ should also increase. Angle values in the radial direction of $r/r_{saug}=0.2$ are conceivable in this instance, that is to say, in the region close to the impeller hub, between 50° and 120° and at $r/r_{saug}=1$ between 85° and 160°. The radius $r_{saug}$ corresponds to the radius of the cylindrical inlet opening of the housing. Between the above-mentioned support locations, the angle may vary in a substantially uniform manner, ideally the angle should increase constantly between the support locations.

It is particularly advantageous for the upper finger surface of the finger to have at least in regions a spacing of from 0.05 to 3 mm with respect to the leading edge of the vane. An optimal wiping of the solids from the impeller leading edge is thereby ensured. An excessively large spacing involves the risk of small solids and fibers not being detected by the wiping finger.

Advantageously, the lateral attack face of the finger or a tangent with respect to the attack face in relation to the tangential extent of the groove should have a (tangential) angle $\delta$ having a value between 120° and 180°, preferably between 140° and 180°, and in a particularly preferred manner a value between 160° and 180°. In this instance, as the angle $\delta$ increases, the discharge of the wiped solids into the groove is facilitated. An angle $\delta$ of 180° would be ideal.

In order to have the smallest possible influence on the flow in the inlet of the impeller, the finger should have a flow-promoting form. Good properties are provided when the finger is constructed as a three-surface pyramid with curved side faces. In order to ensure an adequate wiping function and where applicable in order to achieve an optional cutting action, it is advantageous for the front face, that is to say, the attack face of the finger, to be positioned at an angle γ of from 0° to 30° with respect to a parallel of the rotation axis of the impeller. The rear face of the finger is less critical and can where applicable also be more powerfully inclined with respect to the parallel. In this instance, an angle ε of the rear face of the finger with respect to the parallel of the rotation axis of the impeller between 0° and 50° is recommended.

As a result of the curved side faces of the finger in conjunction with the above-mentioned defined angle ranges, solids can settle on the finger surface only with great difficulty. Ideally, the rear face is configured to be curved twice, in particular constructed to be curved twice in different directions. This additionally reduces the flow-influencing surface of the finger.

The orientation and the specific arrangement of the finger within the inlet are decisive for the efficiency of the wiping action. A relevant matter in this context is the relative position of the finger with respect to the spur of the helical housing and consequently the pressure nozzle. It is advantageous for the finger to be arranged in the vicinity of the spur, preferably located in the rotation direction after the spur. Such an arrangement has another advantage in particular with horizontal pumps. Solids, such as stones, may where applicable accumulate in the lower portion of the pump housing or impeller. By the finger 30 being arranged in the environment of the spur, it is positioned outside this danger zone.

The precise position of the finger may, for example, be determined by the angle φ. The angle φ corresponds to the wrap angle which is defined by the angle of intersection between the perpendicular and a tangent of the attack face of the finger, which tangent intersects the rotation axis of the impeller, wherein the tangent preferably extends through the point of the attack face furthest away from the rotation axis in a radial direction. Possible angle values of the angle φ are between 0° and 45°, preferably between 15° and 35° and ideally between 20° and 30°.

In another advantageous embodiment of the wastewater pump, the selected finger length corresponds to at least 30% of the entire radius $r_{saug}$ of the cylindrical inlet opening, preferably at least 50% and ideally from 70% to 80%.

Optionally, there may further be provision for the finger to provide at least one portion which is in the form of a cutting edge, in particular at the side of the front attack face of the finger, wherein, however, the cutting edge extends perpendicularly to the wiping edge, that is to say, parallel with the rotation axis. Preferably, the cutting edge is provided in the transition region of the finger to the securing element of the finger.

Other advantages and properties of the invention will be appreciated from the embodiment illustrated in the Figures.

DETAILED DESCRIPTION

Figure 1:
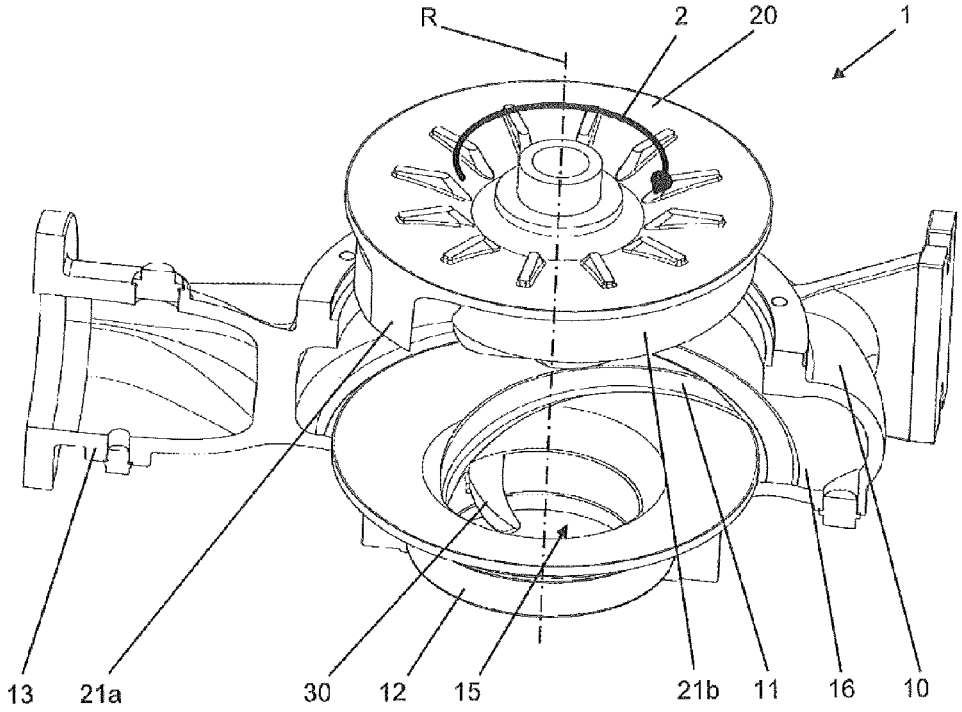
FIG. 1 is a perspective view of the wastewater pump according to an embodiment of the invention with an open pump housing.

FIG. 1 is an exploded view of the wastewater pump 1 according to an embodiment of the invention. This pump comprises a helical housing 10, an intake-side housing insert in the form of a closure wall 12 and the impeller 20 which rotates about the rotation axis R. The running direction is designated 2. The impeller 20, which can be seen in the detailed image of FIG. 4, comprises two vanes 21*a*, 21*b* which are curved backward and by which the conveying medium is drawn in via the cylindrical inlet opening 15 of the closure wall 12 and is conveyed via the conveying space 16 of the helical housing 10 to the pressure nozzle 13 and discharged thereby.

The wastewater which is intended to be conveyed can be displaced with a large number of different solids, for example, fiber materials, which can settle on specific portions of the pump during pump operation. For this reason, there is provided the wiping finger 30 according to the invention which is secured to the cylindrical inner wall of the inlet 15 and which extends in the direction of the rotation axis R. Although the embodiment shown in the Figures has a separate closure wall 12, for the implementation of the invention the closure wall 12 could equally well be omitted and the finger 30 could be fitted directly on the housing wall in the region of the suction mouth. The configuration and operating method of the finger 30 is intended to be set out in greater detail below, the construction of the impeller 20 is intended to be described first.

Figure 4:
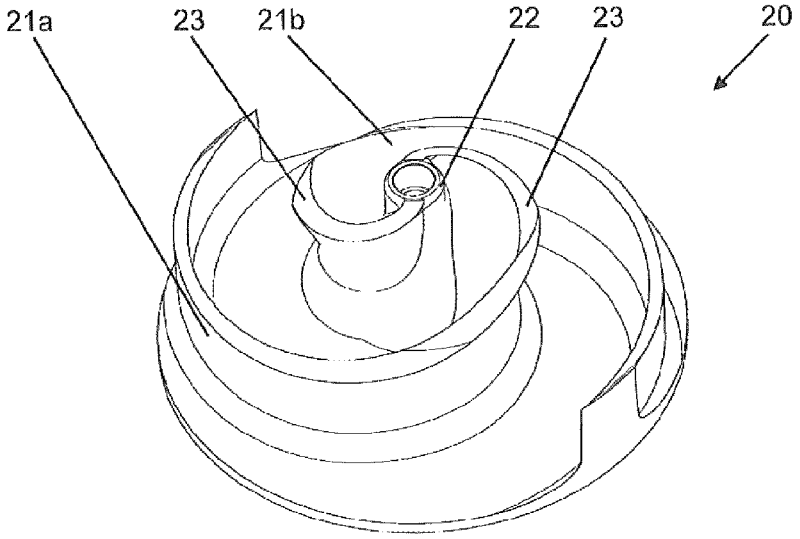
FIG. 4 is a detailed view of the impeller of the wastewater pump according to FIG. 1, FIGS. 5*a* to 5*d* are detailed views of the wiping finger of the wastewater pump according to FIG. 1.

A characteristic feature of the impeller 20 is the path of the leading edges 23 of the vanes 21*a*, 21*b* as shown in FIG. 4. They begin directly at the impeller hub 22, in particular at the height of the upper, free hub end and extend backward in a manner curved radially outward. The leading edges 23 are intended to be understood to be the end faces of the vanes 21*a*, 21*b* which face the suction cover and which extend through the inlet 15.

Figure 7A:
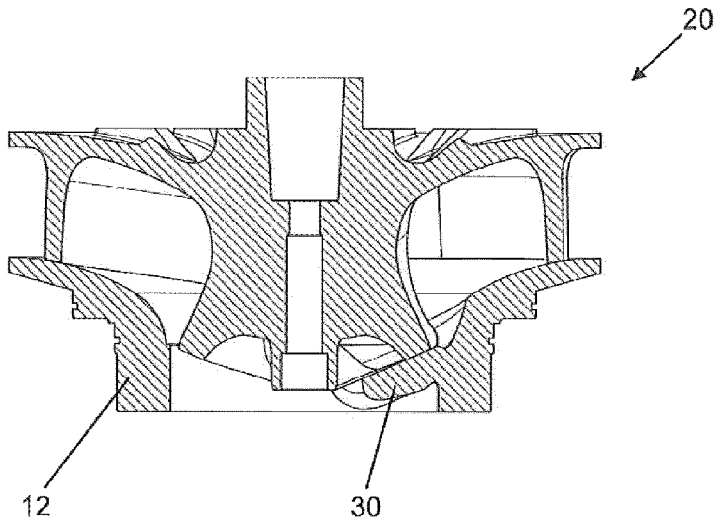
FIGS. 7*a*, 7*b* are sectioned views along the rotation axis R through the housing insert together with the impeller according to FIG. 6.
Figure 7B:
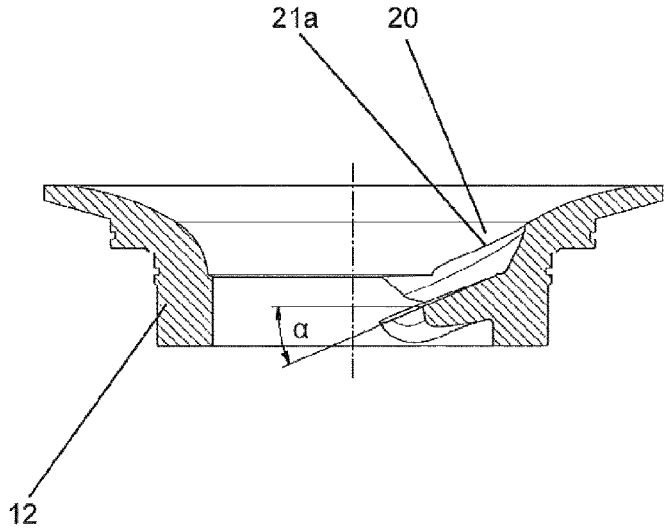

These leading edges 23 are further orientated at a defined angle α with respect to the perpendicular projection face of the rotation axis R. In order to illustrate the selected angle, reference may be made to FIGS. 7*a*, 7*b* which show a sectioned illustration through the impeller 20 and the corresponding closure wall 12. The angle α of the leading edge 23 of the impeller 20 with respect to the horizontal which in the selected illustration form corresponds to a perpendicular projection face with respect to the rotation axis R is depicted here. The selected inclination further allows, in addition to the radial force, an axial force component to be applied to the conveying medium, which optimizes the discharge of solids contained therein, which were detected and wiped away by the finger 30. The discharge thereof is carried out via a helical groove 11 which is provided especially for the purpose inside the intake-side closure wall 12. Ideally, the angle α should be within the range between 5° and 75° or 10° and 45°. In the embodiment shown here, an angle of inclination a of approximately 25° is assumed (see FIGS. 7*a*, 7*b*).

In order to optimize the wiping effect of the finger 30, the shape and position thereof within the inlet 15 must be adapted to the specific impeller and housing construction. The wiping finger 30 is mounted on the inner wall of the inlet 15 of the closure wall and extends in the direction of the rotation axis R. The length of the wiping finger 30 should be at least 30%, preferably at least 50% or at best approximately from 70% to 80% of the radius of the cylindrical inlet 15 which is referred to below as $r_{saug}$.

Figure 5A:
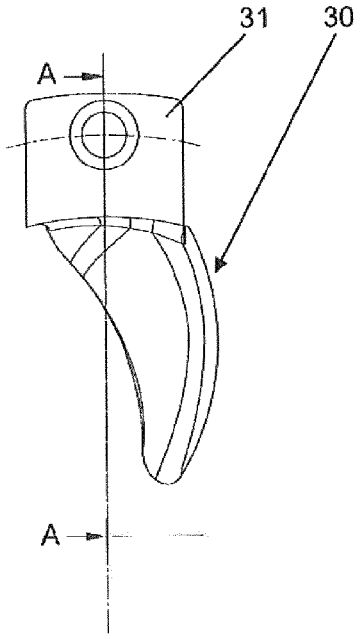
Figure 5B:
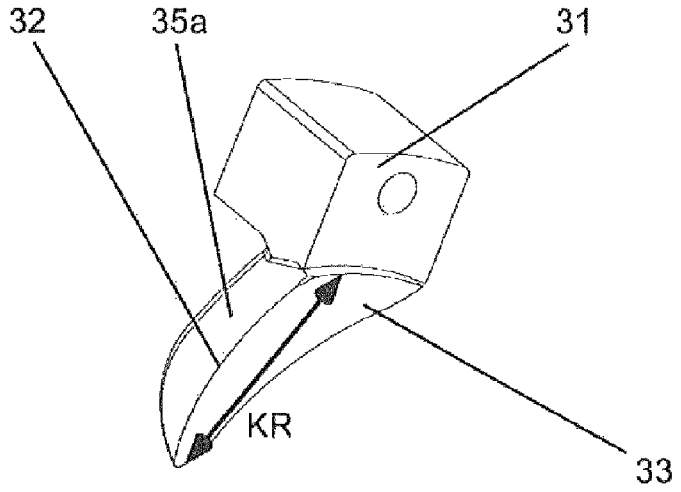

In order to influence the flow in the inlet 15 to the impeller 20 to the smallest possible extent by the wiping finger 30, the finger 30 is formed in the shape of a pyramid having a total of three side faces 33, 35*a*, 35*b* and the base face which abuts the inner wall of the inlet 15. The upper finger surface 33 facing the leading edges 23 of the impeller 20 is in this instance not planar, but instead provided with a continuous curvature, both in the longitudinal finger direction (radial direction KR, see FIG. 5*b*) and in the transverse direction (tangential direction KT, see FIG. 8). Overall, a type of conical face 33 is produced in this instance.

Figure 5C:
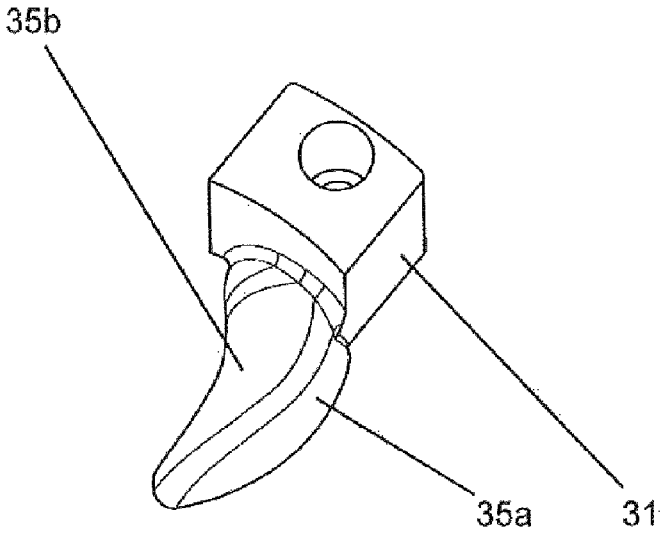
Figure 5D:
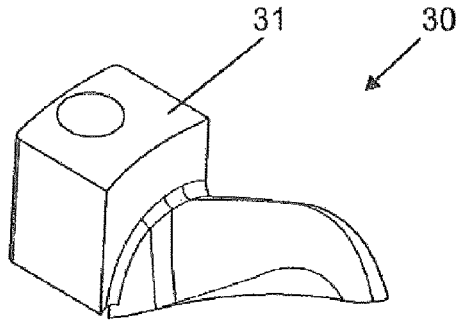
Figure 6:
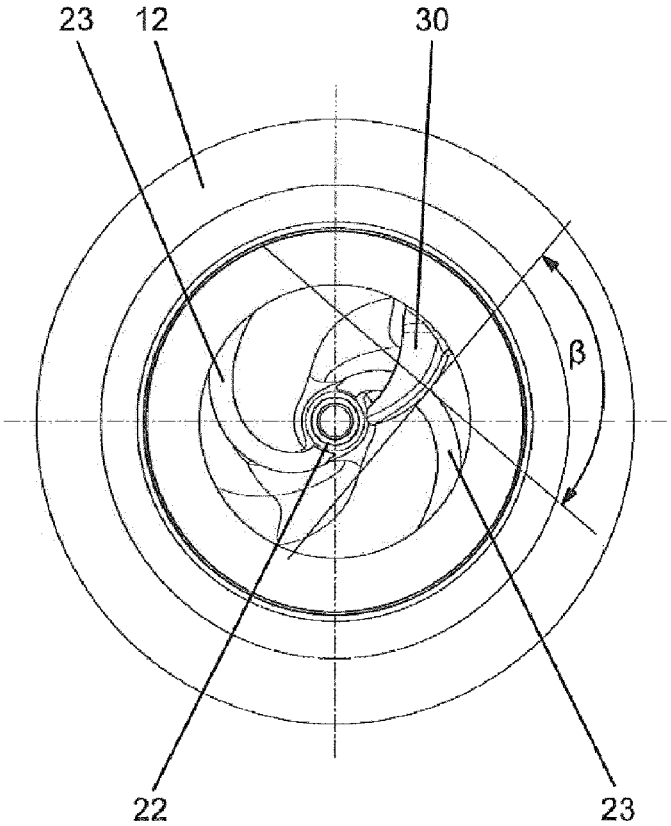
FIG. 6 is an intake-side view of the housing insert of the wastewater pump according to FIG. 1 with the impeller inserted.
Figure 8:
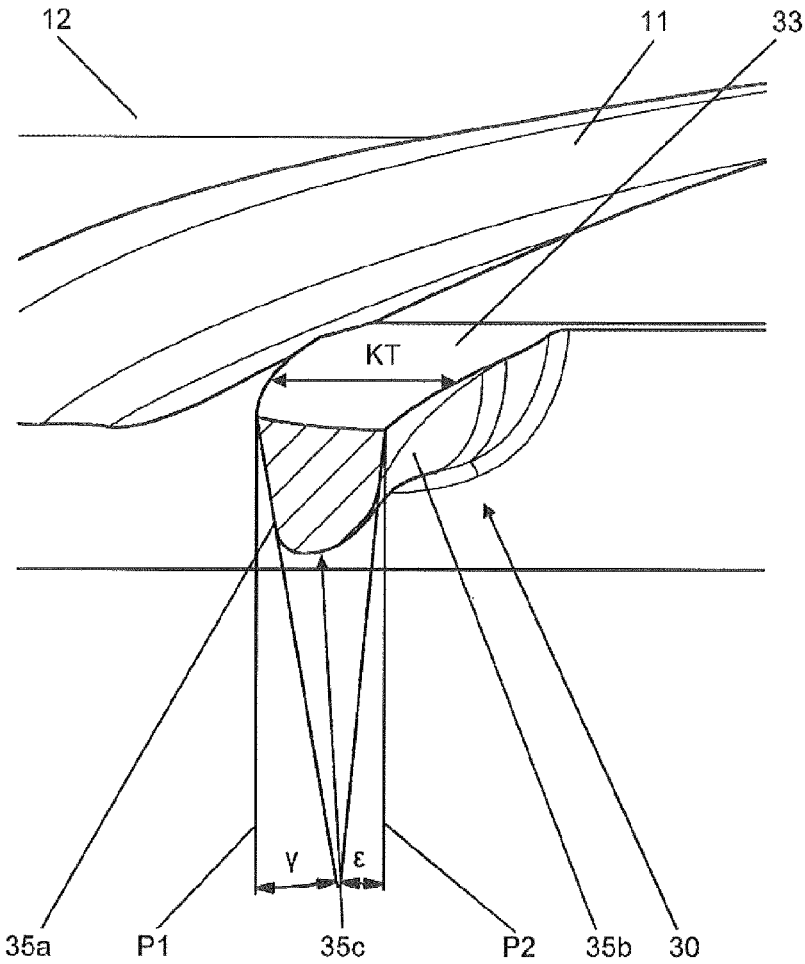
FIG. 8 is a detailed view of the wiping finger together with the groove according to FIG. 6.

The remaining side faces, that is to say, the lateral attack face 35*a* and the rear side face 35*b* also have corresponding curvatures, wherein the rear side face 35*b* even provides a dual curvature in different directions. Cf. in this regard in particular FIG. 5*c*. In order to perform the function of wiping solids and cutting fibers, the front attack face 35*a* of the finger 30 is inclined at an angle γ of from 0° to 30° with respect to the rotation axis R. In FIG. 8, the angle γ with respect to a parallel P1 of the rotation axis R is depicted. The rear face 35*b* of the finger 30 is less critical and may be inclined with an angle ε with respect to the rotation axis R or the parallel P2 with respect to the rotation axis R of from 0° to 50°. Furthermore, the face 35*c* may be rounded tangentially with respect to the adjacent faces 35*a*, 35*b*. When this angle definition is taken into account, solids can settle on the finger 30 only with very great difficulty.

When the impeller 20 is rotated about the rotation axis R in the direction 2, the leading edges 23 of the impeller 20 run toward the lateral attack face 35*a* and then move past the opposing finger surface 33. The transition edge between the lateral attack face 35*a* and upper face 33 forms the so-called wiping edge, by means of which these solids which have settled on the leading edges are wiped away and, as a result of the radial and axial speed of the conveying medium, are discharged into the helical groove 11, via which they are ultimately ejected past the impeller 20 through the conveying space 16 to the pressure nozzle 13.

The spacing between the leading edge 23 and the face 33 or the wiping edge of the wiping finger 30 should be in a range between 0.05 and 3 mm, wherein this spacing may vary in a radial direction, but should to the greatest possible extent remain within the above-mentioned value range. A spacing which is selected to be excessively large involves the risk of small solids not being able to be detected by the wiping finger 30, whereas a spacing which is selected to be too small increases the risk of the wiping finger 30 and leading edge 23 meeting.

Since, as mentioned in the introduction, the leading edge 23 of the impeller 20 is inclined at an angle α with respect to the perpendicular projection face of the rotation axis R, the finger 30 or the upper face 33 or at least the wiping edge should also have a corresponding inclination through the angle α. This can also be seen in FIG. 7*b*. However, the angle of inclination of the leading edge 23 and face 33 do not necessarily have to be exactly identical, but may also have slight differences. In spite of these angular differences, however, the spacing value defined above should be located within the desired value range.

The relative position of the wiping finger 30 with respect to the spur 17 of the helical housing 10 additionally influences the discharge of the wiped solids to the pressure nozzle 13. In particular with a pump which is positioned horizontally, it is advantageous for the wiping finger 30, as shown in the sectioned illustration of FIG. 2, to be located in the rotation direction 2, that is to say, in the illustration of FIG. 2, in a clockwise direction, directly behind the spur 17. Solids, such as stones, may accumulate where applicable in the lower portion of the pump housing or impeller. By arranging the wiping finger 30 in the environment of the spur, it is positioned outside this danger zone.

Figure 2:
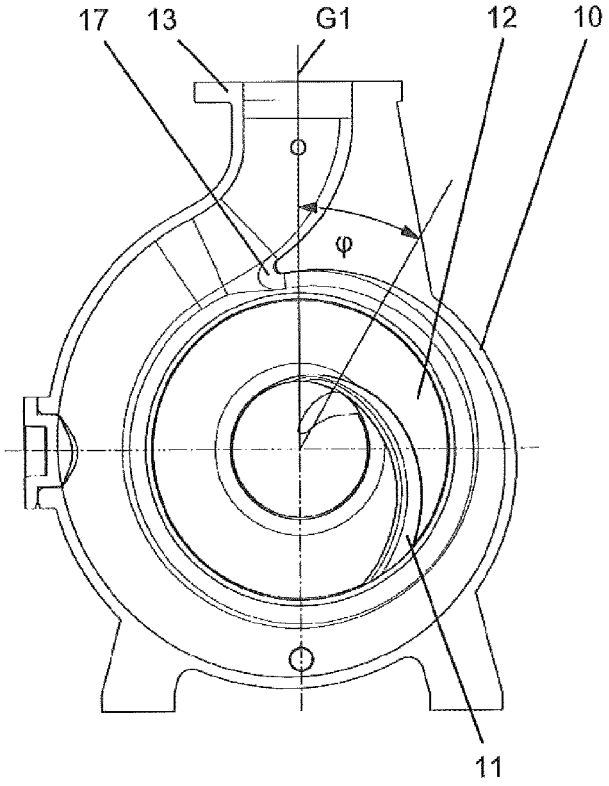
FIG. 2 is a vertical section through the wastewater pump according to FIG. 1, FIGS. 3*a*, 3*b* are detailed views of the housing insert with a wiping finger for the wastewater pump according to FIG. 1.

The relative position of the wiping finger 30 with respect to the spur 17 can be defined by the angle φ depicted in FIG. 2. The angle φ corresponds to the wrap angle which is defined by the angle of intersection between the perpendicular and the straight line G1. The straight line G1 is perpendicular to the rotation axis R and extends through the point of the lateral attack face 35*a* of the wiping finger 30 furthest away in a radial direction from the rotation axis R. Recommended values for the angle φ are in the range between 0° and 45°, wherein an angle of from 20° to 30° has been found to be particularly advantageous.

During pump operation, the leading edge 23 of the vanes 21*a*, 21*b* moves past the upper surface 33. The tangent at the lowest point of the upper face 33 (point of smallest spacing with respect to the leading edge 23) defines the angle β with the tangent of the leading edge. For optimum operation of the finger 30, the angle β should be approximately 90°. In order, however, to reduce a jamming of the fibers between the impeller leading edge 23 and finger 30, the angle β may also increase as the radius r increases from the impeller hub 22. This means that, as the radius r increases, the angle β also increases. For simpler illustration, via the normalized radius $(r-r_{saug})$, wherein $r_{saug}$ represents the radius of the inlet 15, the extent illustrated in FIG. 9 can be assumed.

In this Figure, it can be seen that the angle β close to the center of the impeller 20 may be between 50° and 120° and at the outer edge is between 85° and 160°. The angular extent can be freely selected within this range, but an angle β which continuously increases should optimally be selected.

Figure 3A:
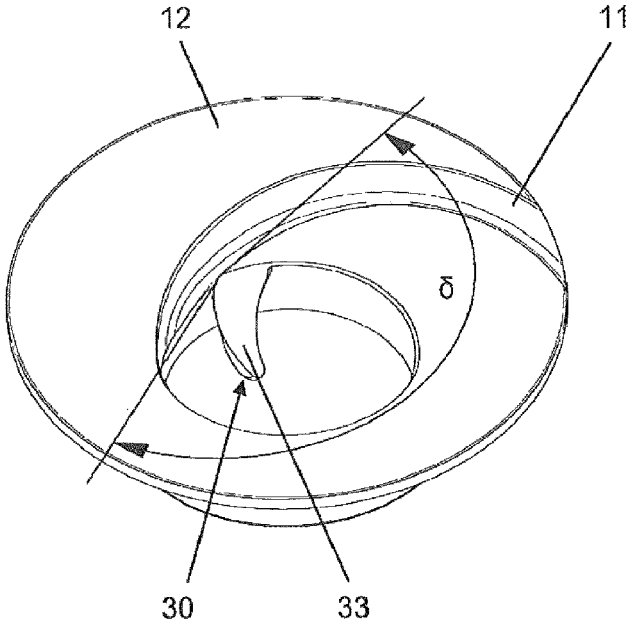
Figure 3B:
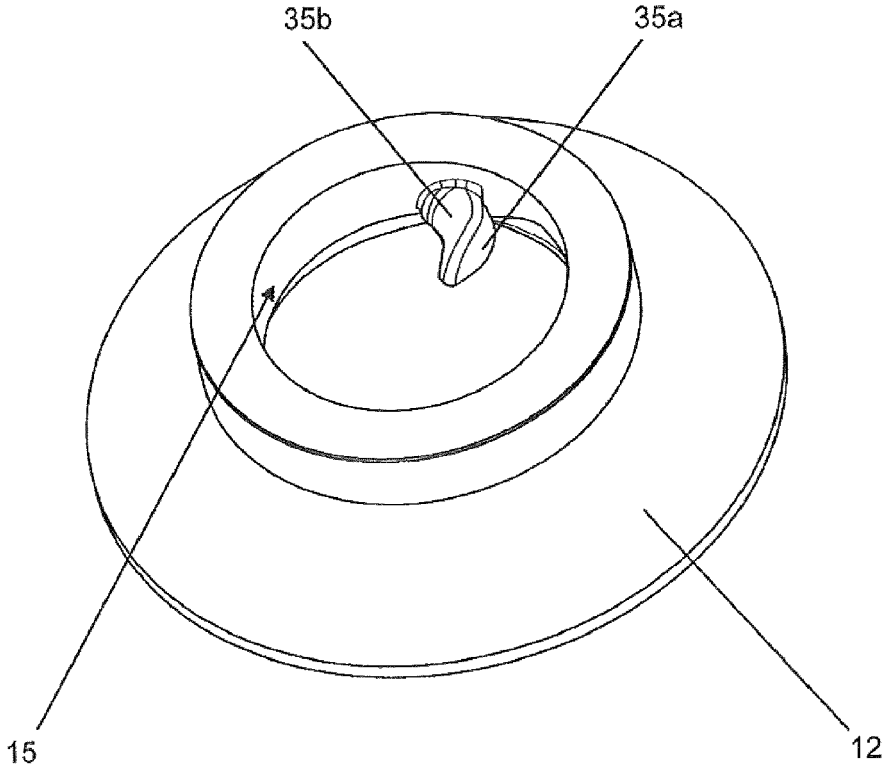

In order to further optimize the wiping action, the lateral attack face 35*a* of the finger 30 should further in relation to the tangential path of the groove 11 define an angle δ between 180° and 120°. This angle δ is illustrated in FIG. 3 and has approximately the value 165° in this instance.

Optionally, the finger 30 may be configured with a cutting edge 32 which extends perpendicularly to the face 33 of the finger in the region of the transition to the securing element 31. Consequently, the cutting edge extends almost parallel with the rotation axis R. By means of the securing element 31, the wiping finger 30 can be releasably connected to the closure wall 12 or the housing 10, wherein it should be ensured here that the securing element 31 does not protrude into the inlet 15 in order to thus prevent any influence on the flow properties within the pump.

Figure 9:
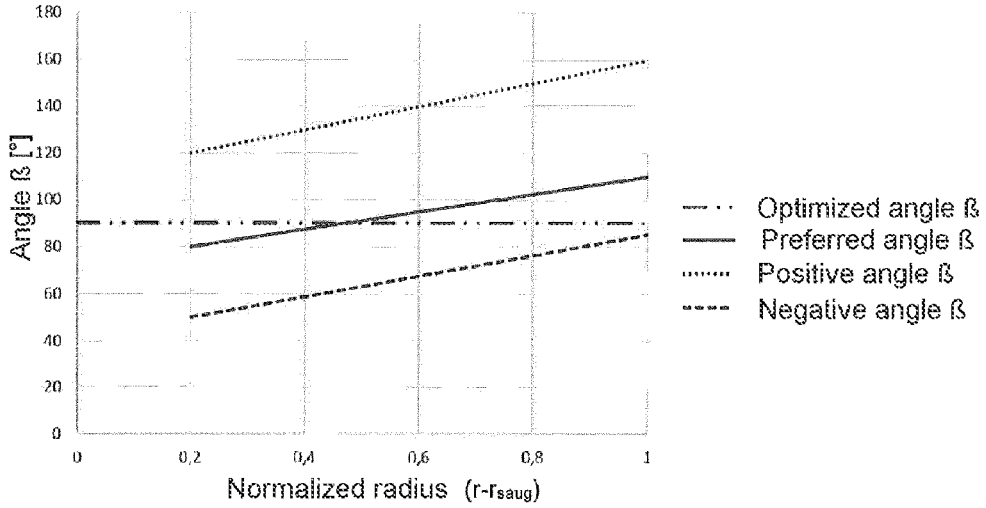
FIG. 9 is a graph of the normalized radius ($r-r_{saug}$) with respect to the angle β.

FIG. 9 shows the angular extent 13 between the impeller leading edge 23 of the impeller 20 and the finger 30.

The invention claimed is:

1. A wastewater pump for conveying solid-laden wastewater, the wastewater pump comprising:

a helical housing having an inlet opening and an inlet inner wall;

an impeller having at least one vane; and at least one finger configured to wipe dirt from a leading edge of the at least one vane of the impeller, wherein the leading edge of the at least one vane extends outward from a hub of the impeller in a manner curved backward relative to a rotation direction of the impeller, the at least one finger extends from the inlet inner wall toward the hub of the impeller, at least one groove is formed in a closure wall of the housing, the leading edge of the at least one vane and an upper surface of the at least one finger facing the leading edge are arranged at an angle $\alpha$ from 5° to 75° with respect to a perpendicular projection face of a rotation axis of the impeller, the leading edge of the at least one vane forms an angle $\beta$ with respect to a front face of the at least one finger, the front face being a surface of the at least one finger on which a flow impinges during an operation of the wastewater pump, the angle $\beta$ at a first normalized radius from the rotation axis of the impeller to a first radius of the inlet opening of 0.2 is between 50° and 120°, the angle $\beta$ at a second normalized radius from the rotation axis of the impeller to a second radius of the inlet opening of 1 is between 85° and 160°, and the angle $\beta$ varies between the first normalized radius of 0.2 and the second normalized radius of 1 in a substantially uniform manner.

2. The wastewater pump as claimed in claim 1, wherein the upper surface of the at least one finger has at least one region with a spacing of 0.05 mm to 3 mm from the leading edge of the at least one vane.

3. The wastewater pump as claimed in claim 1, wherein a tangential angle $\delta$ between the at least one groove and the front face of the at least one finger is between 120° and 180°.

4. The wastewater pump as claimed in claim 1, wherein a tangential angle $\delta$ between the at least one groove and the front face of the at least one finger is between 140° and 180°.

5. The wastewater pump as claimed in claim 1, wherein a tangential angle $\delta$ between the at least one groove and the front face of the at least one finger is between 160° and 180°.

6. The wastewater pump as claimed in claim 1, wherein the at least one finger has a shape of a three-surface pyramid having curved side faces which include the front face, which has an angle $\gamma$ of from 0° to 30° with respect to the rotation axis of the impeller or a first line parallel to the rotation axis of the impeller, and a rear face, which has an angle $\varepsilon$ of from 0° to 50° with respect to the rotation axis of the impeller or a second line parallel to the rotation axis of the impeller.

7. The wastewater pump as claimed in claim 6, wherein the rear face of the at least one finger is curved in a radial direction and curved in a tangential direction.

8. The wastewater pump as claimed in claim 1, wherein the at least one finger is arranged in a vicinity of a spur of the housing at which the flow is directed to an outlet opening of the housing.

9. The wastewater pump as claimed in claim 8, wherein the at least one finger is arranged circumferentially relative to the rotation axis of the impeller.

10. The wastewater pump as claimed in claim 9, wherein the at least one finger is positioned circumferentially with a wrap angle of $\varphi$ relative to the spur from 0° to 45°, the wrap angle $\varphi$ being an angle between a first line from the rotation axis of the impeller to the outlet opening and a second line between the rotation axis of the impeller and a point on the front face furthest away from the rotation axis of the impeller in a radial direction.

11. The wastewater pump as claimed in claim 9, wherein the at least one finger is positioned circumferentially with a wrap angle of $\varphi$ relative to the spur from 15° to 35°, the wrap angle $\varphi$ being an angle between a first line from the rotation axis of the impeller to the outlet opening and a second line between the rotation axis of the impeller and a point on the front face furthest away from the rotation axis of the impeller in a radial direction.

12. The wastewater pump as claimed in claim 9, wherein the at least one finger is positioned circumferentially with a wrap angle of $\varphi$ relative to the spur from 20° to 30°, the wrap angle $\varphi$ being an angle between a first line from the rotation axis of the impeller to the outlet opening and a second line between the rotation axis of the impeller and a point on the front face furthest away from the rotation axis of the impeller in a radial direction.

13. The wastewater pump as claimed in claim 1, wherein the at least one finger has a length that extends in a radial direction and at least partially into the inlet opening.

14. The wastewater pump as claimed in claim 1, wherein the at least one finger has a length that extends in a circumferential direction and at least partially into the inlet opening.

15. The wastewater pump as claimed in claim 1, wherein the at least one finger has a length that extends in both a radial direction and a circumferential direction and at least partially into the inlet opening.

16. The wastewater pump as claimed in claim 1, wherein the at least one finger is releasably connected to the housing or an intake-side housing insert by a securing element formed at a radially outer end side of the at least one finger, and the securing element is configured such that the securing element does not protrude into the inlet opening of the housing.

17. The wastewater pump as claimed in claim 16, wherein the at least one finger includes at least one portion in the form of a cutting edge at a transition region of the at least one finger that extends to the securing element.

18. The wastewater pump as claimed in claim 17, wherein the cutting edge extends in parallel with the rotation axis of the impeller.

* * * * *